United States Patent [19]

DeLuca

[11] 4,441,392

[45] Apr. 10, 1984

[54] CUT WEB MATERIAL DISPENSER WITH WEB CENTERING AND TENSION CONTROL

[75] Inventor: Raymond F. DeLuca, Stamford, Conn.

[73] Assignee: Georgia-Pacific Corporation, Atlanta, Ga.

[21] Appl. No.: 318,278

[22] Filed: Nov. 4, 1981

[51] Int. Cl.[3] ..... B26D 1/56

[52] U.S. Cl. ..... 83/337; 83/335; 83/649; 242/55.3

[58] Field of Search ..... 83/337, 335, 660, 649, 83/334, 345; 242/55.3

[56] References Cited

U.S. PATENT DOCUMENTS

| | | | |
|---|---|---|---|
| 2,812,900 | 6/1950 | Kwitek | 242/56 |
| 4,122,738 | 10/1978 | Granger | 83/314 |
| 4,176,569 | 12/1979 | DeLuca | 83/337 |
| 4,188,844 | 2/1980 | DeLuca | 83/337 |

FOREIGN PATENT DOCUMENTS

| | | | |
|---|---|---|---|
| 618284 | 8/1978 | U.S.S.R. | 83/337 |

*Primary Examiner*—Donald R. Schran

*Attorney, Agent, or Firm*—Banner, Birch, McKie & Beckett

[57] ABSTRACT

Mechanism for cutting a web of rolled flexible sheet material in a dispenser having a feed roller and pinch roller between which the web passes is provided with a knife mounted in the feed roller to be projected outwardly beyond the periphery of the feed roller during a web severing cycle wherein engagement of the pinch roller with the web immediately before the knife penetrates it acts to maintain tension in the web ahead of the knife and a high friction surface portion of the feed roller periphery which is in contact with the roll of material maintains tension in the web behind the knife as the web severing cycle proceeds while peripheral protrusions on the feed roller momentarily bump the roll out of contact with the feed roller during feed roller rotation to permit periphery which is in contact with the roll of material maintains tension in the web behind the knife as the web severing cycle proceeds while peripheral protrusions on the feed roller momentarily bump the roll out of contact with the feed roller during feed roller rotation to permit any loose loop of web behind the feed roller to slip along a low friction feed roller surface portion and jar the roll into parallelism with the feed roller to minimize potential build up of loose roll loops within the dispenser.

3 Claims, 4 Drawing Figures

CUT WEB MATERIAL DISPENSER WITH WEB CENTERING AND TENSION CONTROL

FIELD OF THE INVENTION

The present invention relates to improvements in dispensers for rolls of flexible sheet material and specifically to cutter mechanism for use therein. More particularly, the present invention relates to web centering and tension control associated with this cutter mechanism to achieve effective web severing and prevent jamming in such a dispenser.

DESCRIPTION OF THE PRIOR ART

Dispensers for flexible sheet material, such as paper towels in web form, have long been known to include mechanisms for perforating or severing a web of material to divide it into individual sheets. The perforating or severing mechanism used in such dispensers may include a rotatably mounted knife and a cooperating rotatably mounted roller having a slot therein for receiving the radially outward portion of the knife as the knife rotates past the roller. The web of flexible sheet material is passed between the roller and the knife to be perforated or severed when the radially outward knife portion enters the slot in the roller.

Such mechanisms are satisfactory for perforating or severing relatively unstretchable flexible sheet material, such as uncreped paper towels. However, with the increased use of relatively stretchable flexible sheet materials, such as embossed and creped paper towels, the prior art perforating and severing mechanisms have proved unsatisfactory because the web of sheet material tends to stretch about the cutting edge of the knife instead of being perforated or severed thereby. Although precision rotary shears are known which could be employed for obviating this problem, such shears are much too expensive to be used in the volume of flexible sheet material towel dispensers designed for installation in both commercial and private washrooms.

A substantial improvement over the prior art is found in DeLuca U.S. Pat. No. 4,188,844 in which a knife is pivotably mounted in a slot in the feed roller. The knife swings about an axis which is laterally displaced from the plane of the knife cutting edge for severing the web. This edge is projected outwardly through an opening in the feed roller, beyond the periphery of the feed roller, to cut the web as it passes over the feed roller. The knife carries cam followers displaced from the pivot mounting axis of the knife and stationary cams are mounted adjacent the ends of the feed roller with which the cam followers of the knife engage to positively project and retract the knife cutting edge upon rotation of the feed roller. In such dispensers, the supply roll of material rests upon the feed roller, which guides the material and houses the severing knife.

Such prior art dispensers have, however, encountered certain difficulties. When the supply roll rests upon the feed roller, the axis of the supply roll tends to wobble as it is turned or rotated to dispense flexible material. Often, the axis of the supply roll will not remain parallel to the axis of the feed roller, which causes the flexible material web to unroll unevenly and to spiral off one end of the supply roll. Aggravating this tendency is the resulting inconsistent or varying pressure of the supply roll against the feed roller at each end.

A similar and related problem arises when the friction between the feed roller surface and the web of material is greater than the friction between the outer sheets or adjacent layers of the web where they are wound about the supply roll. Under these conditions, if the feed roller is suddenly stopped, the web of flexible material in contact with the feed roller will also stop, but the angular momentum within the supply roll will cause it to continue turning briefly. With the feeding end of the web of material thus held stationary while the supply roll continues to turn, the outer layers of supply material slip and turn within each other causing a loop of loose web to build up in the supply roll. Such a loose loop will cause the web to pull to one side, aggravating the uneven feeding characteristics and eventually possibly jamming the mechanism. In addition, such a loop cannot easily be removed from the dispenser by merely attempting to withdraw more web material because the flexible sheet material web will not slip relative to the feed roller surface but rather will tend to turn or rotate the feed roller.

SUMMARY OF THE INVENTION

Accordingly, it is a principal object of the present invention to provide a flexible sheet material dispenser in which reliable web cutting is assured by appropriate web tension control and the axis of the supply roll in encouraged to remain parallel to the axis of the feed roller for centered web feeding.

A further object of the invention is to provide a flexible sheet material dispenser wherein the web of flexible material will not tend to spiral off to one side of the supply roll.

A further object of the present invention is to provide a flexible sheet material dispenser wherein formation of a loose loop of web will not occur adjacent the supply roll or in the dispenser housing.

It is an additional object of the invention to provide a flexible sheet material dispenser wherein jamming of the mechanism, due to improper feeding of flexible material or ineffective web cutting, will be minimized.

These and other objects of the invention will become apparent upon consideration of the detailed description of a preferred embodiment of the invention, given in connection with the following drawings.

DETAILED DESCRIPTION OF THE PREFERRED EMBODIMENT

The invention disclosed herein is an improvement in the dispenser for rolls of flexible sheet material and cutter mechanism for use therein disclosed in U.S. Pat. No. 4,188,844, to R. F. DeLuca, which patent disclosure is hereby incorporated by reference. A more complete understanding of the operation of the present dispenser and cutting mechanism may be obtained from a study of that patent.

Figure 1:
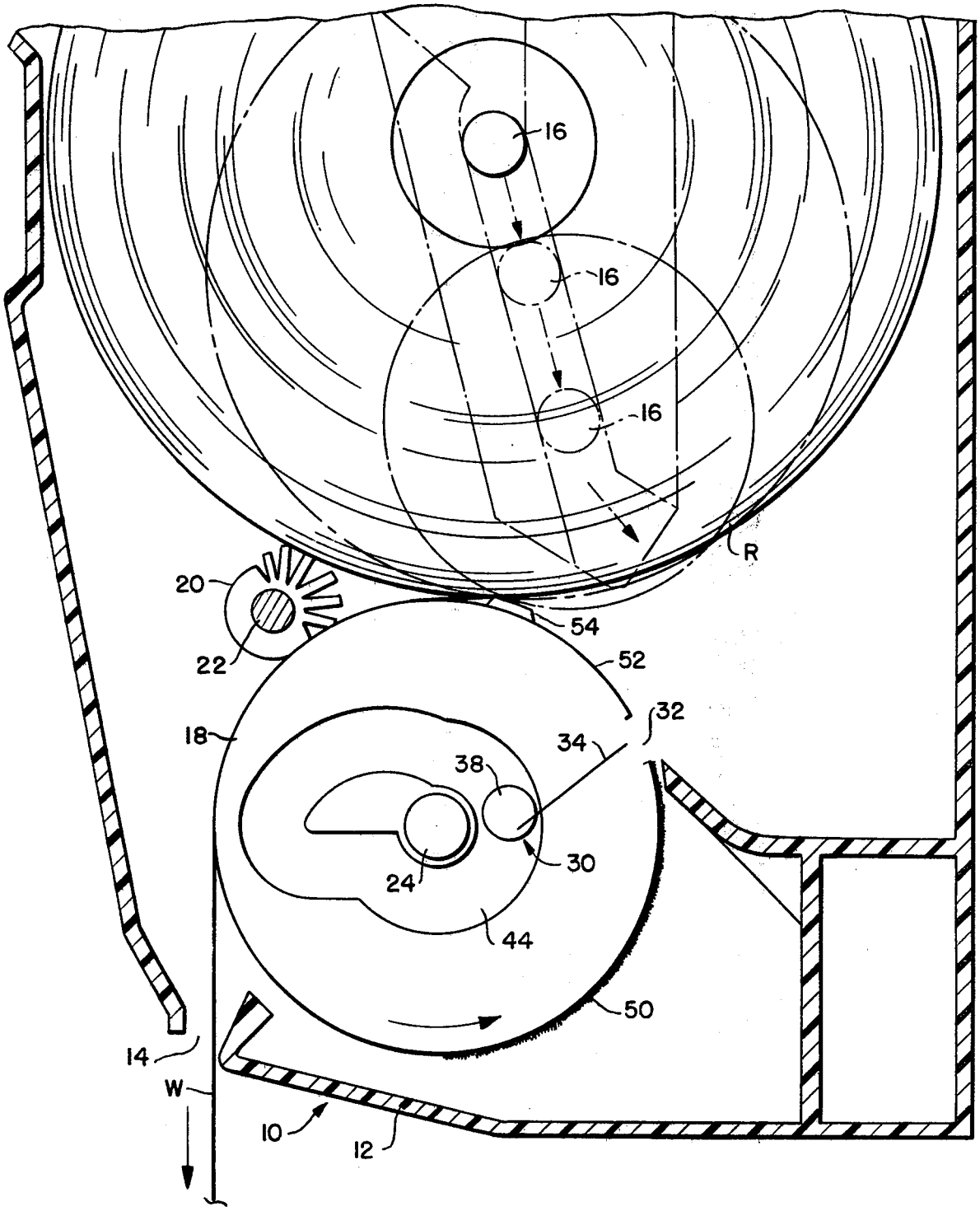
FIG. 1 is a sectional view of the lower portion of the dispenser of this invention showing the cutting mechanism within the chassis in relation to a roll of flexible sheet material.

Referring to FIG. 1, the dispenser 10 has a chassis 12, only a part of which is shown in FIG. 1. The chassis has an opening 14 in its lower forward end through which the web W of flexible sheet material, such as paper towel, passes to be available to the user. The web W is taken from a roll R mounted in the dispenser on a suitable supporting mandrel or shaft 16. The web W passes over a rotatably mounted feed roller 18 and then down and out through opening 14, as it is withdrawn from roll R by the intended towel user. Roll R rests directly against feed roller 18. A pinch roller 20 mounted on shaft 22 is spring biased (FIG. 4) into engagement with the exterior of feed roller 18. The web W of flexible sheet material passes through the nip defined between the pinch roller 20 and feed roller 18.

Figure 3:
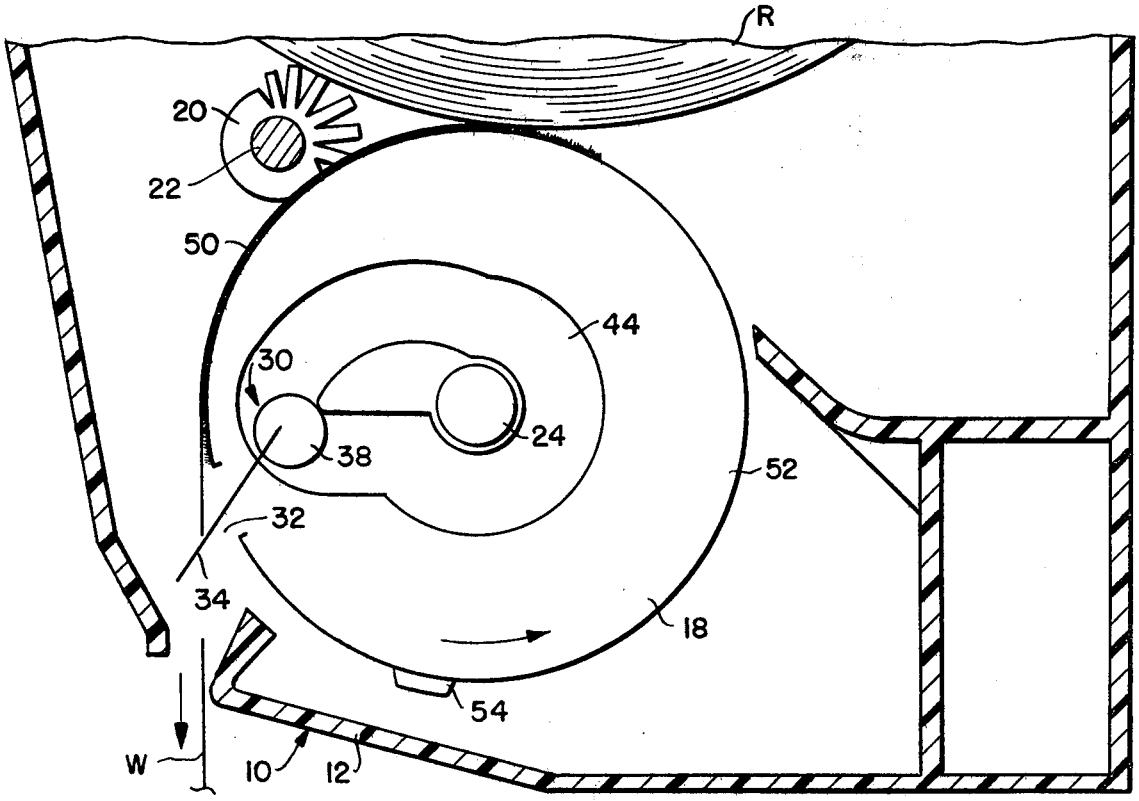
FIG. 3 is the same view as that of FIG. 1, illustrating still another part of the web severing cycle.
Figure 4:
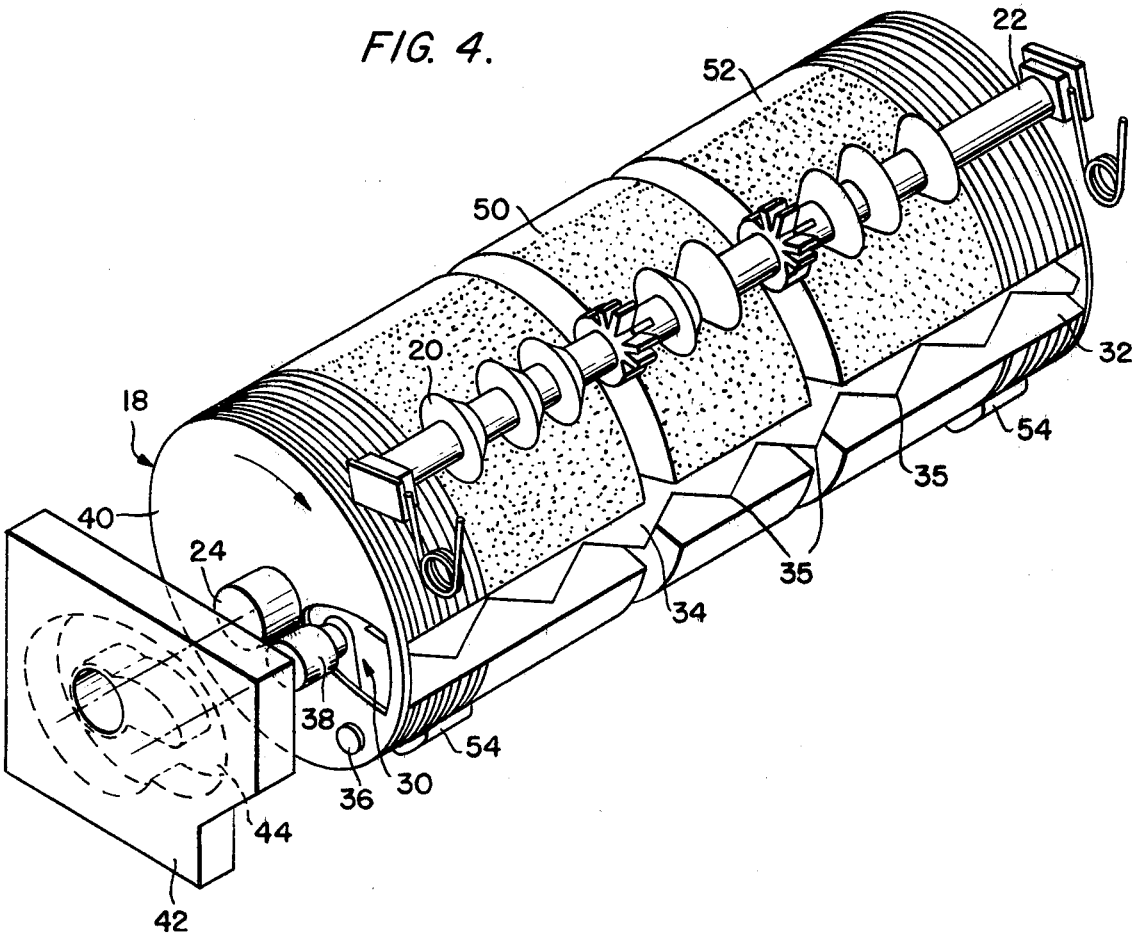
FIG. 4 is a perspective view of the cutting mechanism of the invention separate from the dispenser chassis.

The feed roller 18 is mounted within the chassis 12 of the dispenser 10 on shaft 24 and has a pivotally mounted knife 30 therein. The feed roller 18 has an opening 32 formed in its periphery so that the cutting edge 34 of the knife 30 can be projected beyond the periphery of feed roller 18 and retracted back into the feed roller. The knife 30 is mounted to swing about an axis that is laterally displaced from the plane of the cutting edge 34 of knife 30 and, as shown in FIG. 4, preferably the cutting edge 34 is serrated to provide teeth 35. Control of movement of the knife 30 to project from opening 32 and to retract back into feed roller 18 is achieved by cam follower 38 engaging stationary plate cam 42, one such cam being mounted within the chassis 12 adjacent each end of feed roller 18. Pivotal mounting of the knife 30 is provided by stub 36 (FIG. 4) which provides a pivot axis for the knife 30 displaced from the plane of the knife cutting edge 34. Due to the manner in which the knife 30 is pivotally mounted, cutting edge 34 does not merely reciprocate in opening 32. Rather, as the knife cutting edge 34 projects beyond the periphery of feed roller 18 through opening 32, the knife cutting edge 34 projects increasingly downwardly as well as outwardly throughout the web severing cycle, thereby progressively increasing its frictional and penetrating engagement with web W. The downward angle of knife cutting edge 34 increases with rotation of feed roller 18 as shown by FIG. 3, until knife cutting edge 34 is retracted back within opening 32 in feed roller 18 as it moves beyond the cycle position shown in FIG. 3.

While the above-mentioned DeLuca patent can be referred to for a fuller understanding of the interaction between the pivotally mounted knife 30, cam follower 38, stationary plate cam 34, etc., reference may also be made to the more detailed features of feed roller 18, pinch roller 20, etc., that are disclosed in R. F. DeLuca patent application Ser. No. 897,431 filed Apr. 18, 1978 (now abandoned), and its disclosure is also deemed to be incorporated by reference herein. This disclosure now appears in DeLuca U.S. Pat. No. 4,307,639, issued Dec. 29, 1981 from a continuation application Ser. No. 58,867 filed July 19, 1979 of such earlier abandoned application.

A high friction surface 50, which may be provided by sandpaper or coarse emery cloth, extends over a portion of the periphery of feed roller 18 that is disposed trailing behind feed roller opening 32 and knife cutting edge 34. The remaining portion of the periphery of feed roller 18 has a low friction surface 52, such as provided by a smooth plastic like nylon.

Feed roller 18 is also provided with two protrusions 54, one adjacent each end of the roller. These protrude outwardly from the periphery of feed roller 18 to engage and lift the ends of roll R as is beginning to occur in the feed roller position shown in FIG. 1.

As illustrated in FIG. 4, protrusions 54 are aligned with one another parallel to the axis of feed roller 18. Protrusions 54, however, may be offset from one another circumferentially along the periphery of feed roller 18 by as much as 20° without adversely affecting the performance of their function.

To initiate the web severing cycle, an intended user pulls downwardly on the portion of web W extending below dispenser 10 through opening 14. At the point illustrated in FIG. 1, the knife 30 is entirely retracted back within opening 32 of feed roller 18. Also at this point in the web severing cycle the high friction surface 50 on roller 18 is not contacting web W at any point. The portion of web W that is under pinch roller 20 and all portions of web W in contact with the feed roller 18 are riding on the low friction surface 52, such as that provided by a smooth plastic. The frictional resistance between low friction surface 52 and web W is preferably less than the frictional resistance between adjacent layers of the material making up web W on roll R.

Tension in web W is created by the downward pull of the intended user on web W, causing the web W to unroll from roll R and thereby rotate feed roller 18 as it passes thereover. During this portion of the web severing cycle, rotation of feed roller 18 causes protrusions 54 to bump roll R as it rides on low friction surface 52. The small bump or jar imparted to roll R by protrusions 54 raises roll R up and out of contact with feed roller 18 momentarily. While roll R is suspended above feed roller 18, any loose loop of web that may have accumulated behind or within roll R slips along the low friction surface 52 of feed roller 18, thereby relieving the excess web loop and preventing accumulation of loose web W behind feed roller 18. In addition, the bumping or jarring action imparted by protrusions 54 as roller 18 rotates acts to keep the axis of roll R parallel with the axis of feed roller 18, thereby minimizing the chance that web W will unroll unevenly from roll R and jam the dispenser or cutter mechanism.

Figure 2:
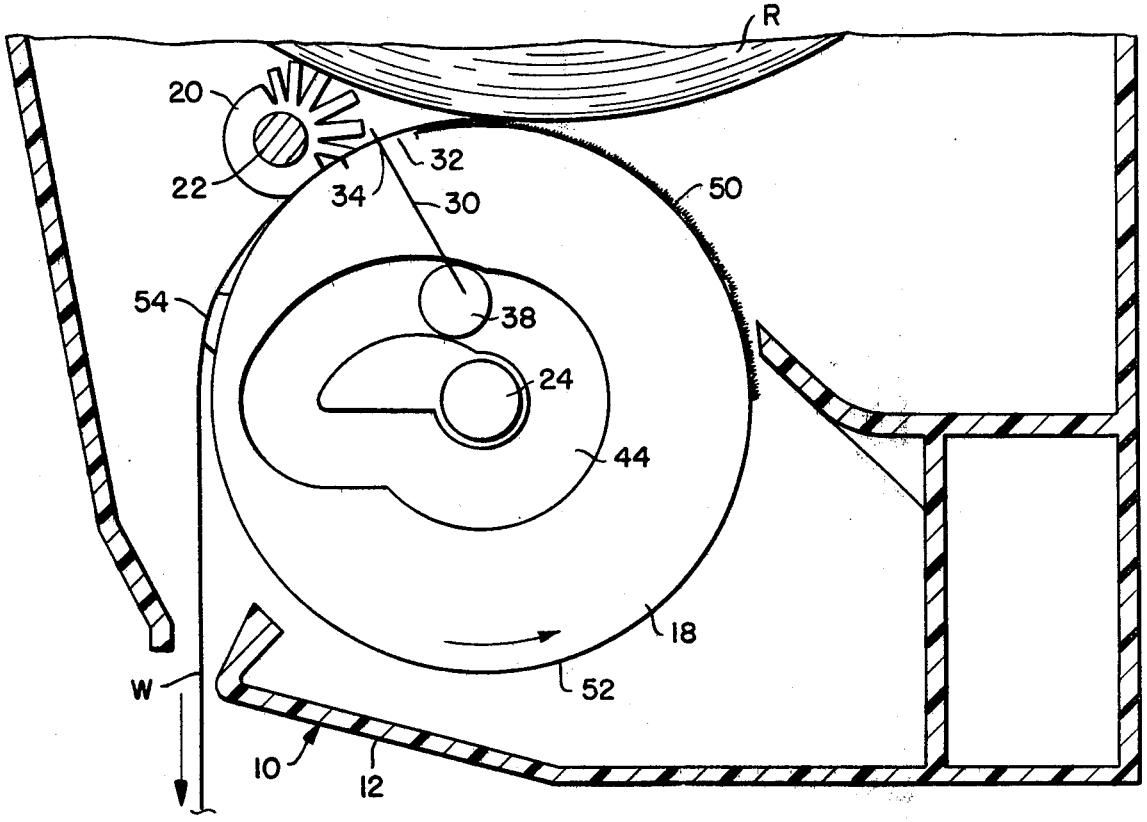
FIG. 2 is the same view as that of FIG. 1, illustrating the cutting mechanism in a different part of the web severing cycle.

In the advanced position of feed roller 18 illustrated in FIG. 2, knife cutting edge 34 has started to project beyond the periphery of feed roller 18 immediately before the point of engagement of pinch roller 20 with feed roller 18. At this point, there is tension on the web W ahead of the knife cutting edge 34 due to the intending user's pull on the web W. And the web W is held firmly against supply roller 18 by spring biased pinch roller 20 pressing the web W against feed roller 18. Tension in the web W behind the knife cutting edge 34 is maintained by the weight of roll R pressing web W against the high friction surface 50 of feed roller 18. It will be noted from FIG. 2 that high friction surface 50 has advanced from its FIG. 1 position by rotation of roller 18 so as to underlie the roll R.

The tension in web W both ahead of and behind the serrated knife cutting edge 34 ensures that the teeth 35 of knife cutting edge 34 will penetrate web W, rather than merely pushing it aside. As feed roller 18 continues to rotate counterclockwise as shown in FIGS. 1–3, knife cutting edge 34 projects further from the periphery of feed roller 18 at an increasingly downward angle, thereby increasing its frictional and penetrating engagement with web W. After knife cutting edge 34 passes ahead of pinch roller 20, a substantial portion of the serrated teeth forming knife cutting edge 34 have penetrated the web W. At this point, pinch roller 20 serves to maintain tension in the web W behind knife cutting edge 34. Adequate tension in the web W behind knife cutting edge 34 to assure complete severing of the web W is provided by the combined pressure of pinch roller 20 pressing web W against high friction surface 50 of feed roller 18, and the weight of roll R resting on high friction surface 50 of feed roller 18. Knife cutting edge 34 has a path of travel longer than that of the periphery of feed roller 18.

The frictional and penetrating engagement of the serrated teeth 35 of knife cutting edge 34 therefore maintain and increase tension in the web W between the point of contact of pinch roller 20 with web W and knife cutting edge 34. At the same time, continued downward force by the intended user's pulling on web W maintains tension in web W ahead of knife cutting edge 34 and provides sufficient force to actuate the cutting mechanism through the remainder of the web severing cycle. Actually, the interaction between the downwardly angled knife edge 34 as it progressively projects out of roller 18 and the pull on the web W by the user promotes complete severing of the web W to dispense a web section to the user.

In the more advanced position of feed roller 18 illustrated in FIG. 3, knife cutting edge 34 has severed a portion of web W to provide the intended user with a web section of convenient size. A return spring as shown in the above-mentioned U.S. Pat. No. 4,188,844 may be employed to return feed roller 18 from the position illustrated in FIG. 3 to the initial position of the web severing cycle generally illustrated in FIG. 1.

The web severing cycle is started over by an intended user's pulling downwardly on the portion of web W extending through opening 14 dispenser 10 after the return spring (not shown) has returned feed roller 18 to its at rest position. Thus, the web centering and web roll leveling mechanism provides a dispenser for a continuous roll of web material that dependably dispenses conveniently sized web sections without jamming.

The forgoing sets forth a detailed description of improvements in a dispensing and cutting mechanism particularly adapted to be used in a dispenser such as disclosed in U.S. Pat. No. 4,188,844. However, the improvements are not restricted for use solely in this type dispenser. Moreover, it is recognized that various modifications of both the dispenser and the cutting mechanism of the invention may occur to those skilled in the art. Therefore, the scope of the invention is to be limited solely by the scope of the appended claims.

I claim:

1. In a dispenser for rolled flexible sheet material having:

a chassis adapted to be attached to a wall;

means on said chassis for rotatably supporting a roll of flexible sheet material;

a feed roller rotatably mounted on said chassis providing guide means for a web of flexible sheet material drawn from the roll, said roller being disposed adjacent said supporting means to define a space between said roller and said supporting means for the roll carried by said supporting means to rest on said roller with said roller guide means guiding the web of flexible sheet material withdrawn from the roll to a user; and cutter mechanism carried by said chassis in association with said feed roller for cutting the web at intervals along the web to divide the web into individual sheets;

the improvement wherein said feed roller has at least one protrusion on the peripheral surface near each end thereof for momentarily lifting the roll of flexible sheet material off the surface of said feed roller during rotation of said feed roller so as to jar the roll carried by said supporting means into parallelism with the feed roller and free the web momentarily to permit any loose loop of web to be pulled out by the user.

2. In a dispenser as recited in claim 1 wherein said protrusions are circumferentially spaced within approximately 20 degrees of an arc of the feed roller surface from said protrusions being in longitudinal alignment with each other.

3. In a dispenser as recited in claim 2 wherein said protrusions are longitudinally aligned with each other on said feed roller peripheral surface.

* * * * *